US011414288B2

(12) United States Patent
Kobayashi et al.

(10) Patent No.: US 11,414,288 B2
(45) Date of Patent: Aug. 16, 2022

(54) METHOD AND DEVICE FOR CORRECTING MEANDERING IN NON-CONTACT CONVEYING APPARATUS FOR STRIP MATERIAL

(71) Applicant: JFE Steel Corporation, Tokyo (JP)

(72) Inventors: Hirokazu Kobayashi, Tokyo (JP); Yuhei Iwami, Tokyo (JP); Shuhei Narita, Tokyo (JP); Masanori Hoshino, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 185 days.

(21) Appl. No.: 16/763,594

(22) PCT Filed: Nov. 9, 2018

(86) PCT No.: PCT/JP2018/041613
§ 371 (c)(1),
(2) Date: May 13, 2020

(87) PCT Pub. No.: WO2019/098127
PCT Pub. Date: May 23, 2019

(65) Prior Publication Data

US 2020/0361735 A1 Nov. 19, 2020

(30) Foreign Application Priority Data

Nov. 16, 2017 (JP) ..... JP2017-220816

(51) Int. Cl.
*B65H 23/24* (2006.01)
*B65H 23/038* (2006.01)
(Continued)

(52) U.S. Cl.
CPC ..... *B65H 23/24* (2013.01); *B65H 20/14* (2013.01); *B65H 23/038* (2013.01); *C21D 9/63* (2013.01);
(Continued)

(58) Field of Classification Search
CPC ..... B65H 23/038; B65H 23/24; B65H 2404/15212; C21D 9/63
See application file for complete search history.

(56) References Cited

U.S. PATENT DOCUMENTS 4,069,595 A 1/1978 Ahibert et al.
4,200,211 A 4/1980 Yamagishi et al.
(Continued)

FOREIGN PATENT DOCUMENTS

CN 1514692 A 7/2004
CN 1788992 A 6/2006
(Continued)

OTHER PUBLICATIONS

Extended European Search Report for European Application No. 18 878 100.9, dated Dec. 17, 2020, 7 pages.
(Continued)

*Primary Examiner* — William E Dondero
(74) *Attorney, Agent, or Firm* — RatnerPrestia

(57) ABSTRACT

In a method and a device for correcting meandering of a strip material in an apparatus that performs conveyance of the strip material at a non-contact state by floating a continuously traveling strip material by a floater group, the strip material is tilted by forcibly changing a height position in the widthwise direction of the strip material in at least one of a zone between the most upstream floater in the floater group and a conveyance roll located immediately upstream of such a floater, a zone between two adjacent floaters, and a zone between the most downstream floater in the floater group and a conveyance roll located immediately downstream of such a floater, whereby the height position in the widthwise direction of the strip material above the floater is changed and a static pressure applied to the strip material above the floater is changed to correct meandering thereof.

9 Claims, 3 Drawing Sheets

(51) Int. Cl.
*C21D 9/63* (2006.01)
*B65H 20/14* (2006.01)

(52) U.S. Cl.
CPC ..... *B65H 2404/15212* (2013.01); *B65H 2701/173* (2013.01)

(56) References Cited

U.S. PATENT DOCUMENTS

| | | | |
|---|---|---|---|
| 7,204,401 | B2 | 4/2007 | Suzuki et al. |
| 8,381,902 | B2 | 2/2013 | Morita et al. |
| 9,211,573 | B2 | 12/2015 | Hayashi et al. |
| 9,274,459 | B1 | 3/2016 | Tokoro |
| 10,207,303 | B2 | 2/2019 | Ueno et al. |

FOREIGN PATENT DOCUMENTS

| | | | |
|---|---|---|---|
| CN | 102047094 | A | 5/2011 |
| CN | 103269810 | A | 8/2013 |
| CN | 103569713 | A | 2/2014 |
| CN | 105388737 | A | 3/2016 |
| CN | 105934285 | A | 9/2016 |
| DE | 29712608 | U1 | 9/1997 |
| EP | 0506390 | A1 | 9/1992 |
| JP | 54162655 | A | 12/1979 |
| JP | 2200796 | A | 8/1990 |
| JP | 4301730 | A | 10/1992 |
| JP | 5193802 | A | 8/1993 |
| JP | 5213502 | A | 8/1993 |
| JP | 06107360 | A | 4/1994 |
| JP | 11116114 | A | 4/1999 |
| JP | 201392326 | A | 5/2013 |
| JP | 2015131705 | A | 7/2015 |

OTHER PUBLICATIONS

International Search Report and Written Opinion for International Application No. PCT/JP2018/041613, dated Jan. 29, 2019, 5 pages.
Japanese Office Action for Japanese Application No. 2019-510389, dated Oct. 2, 2019, with Concise statement of Reievance of Office Action, 4 pages.
Chinese Office Action for Chinese Application No. 201880072863.6, dated Dec. 24, 2020 with Search Report, 12 pages.
Korean Office Action for Korean Application No. 10-2020-7013045, dated Mar. 15, 2022, with Concise Statement of Relevance of Office Action, 4 pages.

METHOD AND DEVICE FOR CORRECTING MEANDERING IN NON-CONTACT CONVEYING APPARATUS FOR STRIP MATERIAL

CROSS REFERENCE TO RELATED APPLICATIONS

This is the U.S. National Phase application of PCT/JP2018/041613, filed Nov. 9, 2018, which claims priority to Japanese Patent Application No. 2017-220816, filed Nov. 16, 2017, the disclosures of these applications being incorporated herein by reference in their entireties for all purposes.

FIELD OF THE INVENTION

This invention relates to a method for correcting meandering of a strip material in a non-contact conveying apparatus of a strip material that performs conveyance of a continuously traveling strip material at a non-contact state with conveyance rolls while floating the strip material by a floater group comprising one or more floaters, and a device for correcting the meandering by using such a method.

BACKGROUND OF THE INVENTION

The manufacturing process of steel products includes some steps for subjecting a strip material such as cold rolled steel strip to various treatments such as heat treatment, plating treatment, painting treatment and so on while keeping the strip material travel continuously. In such steps, "roll conveyance" in which the strip material is conveyed while being supported in contact with a roll is usually used as a means for the conveyance of the strip material.

However, the conventional roll conveyance method has problems that, for example, in a step when a strip material such as cold rolled steel strip is coated on its surface with various coatings, then dried and baked or when a strip material is subjected to a heat treatment at a high temperature while traveling continuously, defects such as scratches, scraping and the like are easily caused on the material surface or coated film due to the contact between the strip material and the conveyance roll. As a method for solving such problems is developed a non-contact conveying apparatus for the conveyance of a strip material at a non-contact state with the conveyance roll by using a floater which can float the strip material by a gaseous pressure or the like.

Since the strip material is floated in the non-contact conveying apparatus that uses such a floater, the friction force caused by the contact with a supporter is not developed. Therefore, it is pointed out that the non-contact conveying apparatus has a problem in the sheet passing stability that the strip material is slipped laterally to cause meandering or flapped by air draft or the like jetted to float the strip material. Many examinations have been made to prevent the floated strip material from meandering and flapping for stable conveyance of the strip material.

As a method for correcting the meandering, for example, Patent Literature 1 proposes a conveyance method of a strip material by using a floater that supports the strip material at a non-contact state like a catenary form by jetting gas in which a side plate having a height higher than a usual conveyance level of the strip material is arranged outside each widthwise end portion of the strip material above the floater, whereby a meandering strip material can be conveyed without each widthwise end portion thereof coming in contact with the side plate. In the floater of Patent Literature 1, however, the height of only the outermost side plate in the widthwise direction of the strip material is made high, so that driving force for returning the strip material to the center is not developed as far as the strip material is not largely meandered. Therefore, it is difficult to convey the strip material in the central part in the widthwise direction at a high accuracy when the meandering amount of the strip material is relatively small.

As a method for correcting meandering even when a meandering amount is small, Patent Literature 2 discloses a device for preventing meandering of a strip material by arranging a steering roll at an outlet side of a horizontal floater for floating a traveling strip material, winding the strip material therearound, and swinging the steering roll so as to forcibly correct the meandering of the strip material.

PATENT LITERATURES

Patent Literature 1: JP-A-H06-107360
Patent Literature 2: JP-A-H11-116114

SUMMARY OF THE INVENTION

In the method disclosed in Patent Literature 2, however, strong contact force (friction force) works between the steering roll and the strip material, which has a bad influence on the surface of the strip material to be conveyed at a non-contact state while sufficient meandering correction force can be obtained.

Aspects of the invention are made in view of the above problems inherent to the prior art, and an object thereof is to propose a method for correcting meandering of a strip material in a conveying apparatus for the strip material at a non-contact state while floating the strip material by jetting gas or the like, in which, even when the meandering amount of the strip material is small, the meandering of the strip material can be corrected to perform stable conveyance without adversely affecting the surface of the strip material and to provide a device for correcting the meandering.

The inventors have made various studies for solving the above task. As a result, it has been found out that, when a continuously traveling strip material is conveyed while being floated by a floater group comprising one or more floaters, meandering of the strip material can be controlled with a high accuracy even when the meandering amount is small, by forcibly changing a height position in the widthwise direction of the strip material so as to tilt thereof in at least one of a zone between the most upstream floater in the floater group and a conveyance roll located immediately upstream of such a floater, a zone between two adjacent floaters, and a zone between the most downstream floater in the floater group and a conveyance roll located immediately downstream such a floater, and as a result, aspects of the invention have been accomplished.

That is, certain aspects of the invention propose a method for correcting meandering of a strip material in an apparatus that performs conveyance of a continuously traveling strip material at a non-contact state while floating the strip material by a floater group comprising one or more floaters arranged in line, characterized in that the strip material is tilted by forcibly changing a height position in the widthwise direction of the strip material in at least one of a zone between the most upstream floater in the floater group and a conveyance roll located immediately upstream of such a floater, a zone between two adjacent floaters, and a zone between the most downstream floater in the floater group and a conveyance roll located immediately downstream of such a floater to change the height position in the widthwise direction of the strip material above the floater, whereby a static pressure applied to the strip material above the floater is changed to correct meandering thereof.

The method for correcting meandering of a strip material according to aspects of the invention is characterized in that a cant roll is arranged in the zone where the strip material is tilted so as to come in contact with the lower face of the traveling strip material and push up the strip material and the cant roll is tilted with respect to a horizontal surface to change the height position of the cant roll in the widthwise direction of the strip material, whereby the strip material is tilted.

The method for correcting meandering of a strip material according to aspects of the invention is characterized in that an arrangement distance of the cant roll falls within S/2 from the center of the floater, where S is a distance between a center of the most upstream floater in the floater group and a center of the conveyance roll located immediately upstream of such a floater, a distance between the centers of the two adjacent floaters, or a distance between a center of the most downstream floater in the floater group and a center of the conveyance roll located immediately downstream of such a floater.

The method for correcting meandering of a strip material according to aspects of the invention is characterized in that a pushing-up amount L of the cant roll falls within the range of H/3 to 6H with respect to a pass line of the strip material before the arrangement of the cant roll, where H is an average floating amount of the strip material above the floater.

The method for correcting meandering of a strip material according to aspects of the invention is characterized in that a tilt angle of the cant roll falls within the range of ±0.3 to 5° with respect to a horizontal surface.

The method for correcting meandering of a strip material according to aspects of the invention is characterized in that the tilt angle of the cant roll is controlled by feed-back control and/or feed-forward control based on measurement results of the meandering amount of the strip material.

The method for correcting meandering of a strip material according to aspects of the invention is characterized in that a peripheral speed of the cant roll is controlled within the range of ±4 m/min with respect to a conveyance speed of the strip material.

Also, certain aspects of the invention include a device for correcting meandering of a strip material in an apparatus that performs conveyance of a continuously traveling strip material at a non-contact state while floating the strip material by a floater group comprising one or more floaters arranged in line, characterized in that the device is provided with a tilting means for correcting meandering of a strip material in at least one of a zone between the most upstream floater in the floater group and a conveyance roll located immediately upstream of the floater, a zone between two adjacent floaters, and a zone between the most downstream floater in the floater group and a conveyance roll located immediately downstream of such a floater and the tilting means forcibly changes the height position in the widthwise direction of the strip material to tilt thereof and change the height position in the widthwise direction of the strip material above the floater, whereby a static pressure applied to the strip material above the floater is changed to correct meandering thereof.

The device for correcting meandering of a strip material according to aspects of the invention is characterized the tilting means for correcting meandering of the strip material is provided with a cant roll arranged so as to come in contact with the lower face of the traveling strip material and push up the strip material in the zone where the strip material is tilted and the cant roll is tilted with respect to a horizontal surface to change a height position of the cant roll in the widthwise direction of the strip material, whereby the strip material is tilted.

The device for correcting meandering of a strip material according to aspects of the invention is characterized in that the cant roll is arranged in a position within S/2 from the center of the floater, where S is a distance between a center of the most upstream floater in the floater group and a center of the conveyance roll located immediately upstream of such a floater, a distance between the centers of the two adjacent floaters, or a distance between a center of the most downstream floater in the floater group and a center of the conveyance roll located immediately downstream of such a floater.

The device for correcting meandering of a strip material according to aspects of the invention is characterized in that the cant roll can push up the strip material within the range of H/3 to 6H with respect to a pass line of the strip material before the arrangement of the cant roll, where H is an average floating amount of the strip material above the floater.

The device for correcting meandering of a strip material according to aspects of the invention is characterized in that the tilt angle of the cant roll can be controlled within the range of ±0.3 to 5° to a horizontal surface.

The device for correcting meandering of a strip material according to aspects of the invention is characterized in that the tilt angle of the cant roll is controlled by feed-back control and/or feed-forward control based on measurement results of the meandering amount of the strip material.

According to aspects of the invention, in the conveying apparatus for conveying a continuously traveling strip material at a non-contact state with a conveyance roll while floating the strip material by the floater, the strip material is forcibly tilted in a zone other than ones where the strip material is floated by the floater to thereby correct meandering of the strip material, so that the strip material can be returned to a center position in the widthwise direction even at a slight meandering amount, whereby it is possible to convey the strip material stably.

DETAILED DESCRIPTION OF EMBODIMENTS OF THE INVENTION

Figure 1:
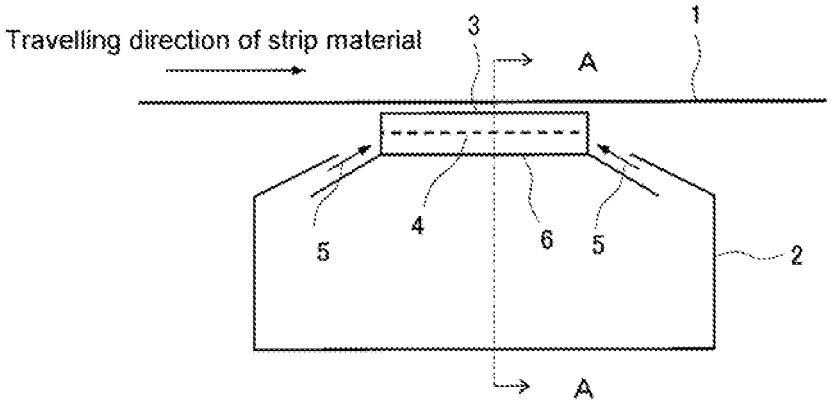
FIG. 1 is a side view of a floater used in a non-contact conveyance of a strip material.

FIG. 1 is a side view of a floater that performs conveyance of a continuously traveling strip material at a floated state which can be used in accordance with aspects of the invention as an example. The floater is to convey the strip material at a floated state by jetting gas toward a lower face of the strip material from underneath thereof. Concretely, a floater 2 is arranged underneath a traveling strip material 1. The pressure in the interior of the floater 2 is made higher than atmospheric pressure by feeding gas from a fan, a blower or the like not shown. The high-pressure gas in the interior of the floater 2 is jetted from a slit-like gas jetting port (slit nozzle) 5 disposed on the top portion of the floater 2 in the widthwise direction of the strip material toward the lower face of the strip material. The slit nozzle 5 is arranged at two places in the traveling direction of the strip material, and the gas jetting directions from these slit nozzles are opposite to each other. Therefore, the gas jetted from the slit nozzle 5 is confined between the strip material 1 and a top plate 6 located in a top portion of the floater to generate a static pressure, and the strip material 1 is supported at a floating state by the static pressure.

Figure 2:
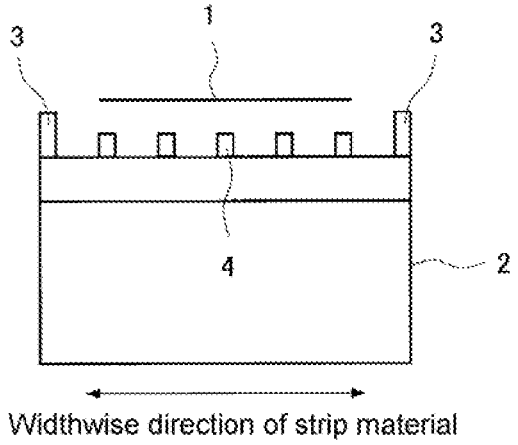
FIG. 2 is a sectional view of a floater used in a non-contact conveyance of a strip material.

FIG. 2 is a sectional view of the floater taken along a line A-A in FIG. 1. A plurality of rib plates 4 are stood on the top plate 6 in the top portion of the floater at a given interval in the widthwise direction of the strip material. The rib plates 4 prevent the outflow of the gas that is jetted from the slit nozzle 5 toward the widthwise direction to stably generate static pressure between the strip material 1 and the top plate 6, whereby the strip material 1 can be floated stably. In addition to the rib plates 4 arranged in the widthwise direction, a plurality of rib plates may be stood in the traveling direction of the strip material from a viewpoint of suppressing outflow of the gas jetted from the slit nozzle 5 toward the traveling direction of the strip material. Side plates 3 having a height higher than that of the rib plates 4 are stood on both outer sides of the rib plates 4 or on both widthwise end portions of the top plate 6 in the widthwise direction of the strip material to prevent the meandering of the strip material.

Figure 3:
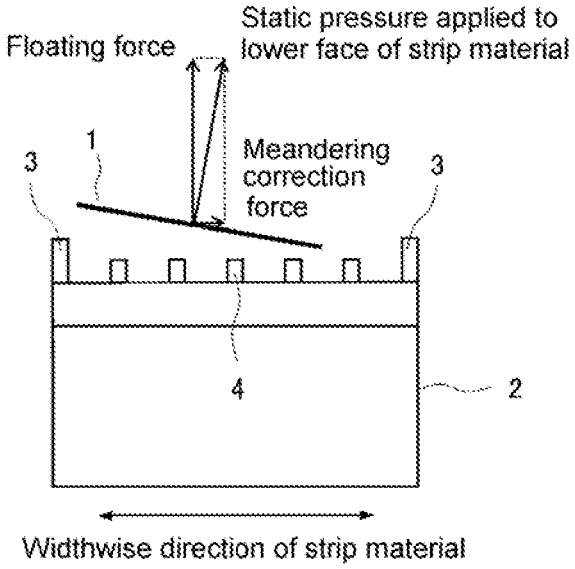
FIG. 3 is a schematic view illustrating a meandering correction theory in a floater by the prior art.

In the following there will be explained the performance that the floater shown in FIGS. 1 and 2 has for correcting meandering of a strip material, with reference to FIG. 3. When the strip material 1 meanders on one side (left side in FIG. 3), the gas pathway between the side plate 3 at the meandering side and the strip material 1 is made narrow, so that static pressure generated in the lower face of the strip material 1 increases. As a result, the floating amount of the strip material 1 at the meandering side increases, and the strip material 1 is rendered into a tilted state as shown in FIG. 3. The static pressure applied to the lower face of the strip material 1 acts as a force in a direction perpendicular to the surface of the strip material. This force can be divided into vectors of a vertical force and a horizontal force. The vertical force is a floating force supporting the deadweight of the strip material 1, and the horizontal force acts as a correction force for correcting meandering of the strip material 1. That is, when the strip material 1 is tilted above the floater, a component force in the horizontal direction of the static pressure applied to the lower face is generated, and the component force acts as a correction force for correcting the meandering. As a result, the strip material 1 can be conveyed above the floater without continuing the meandering.

To obtain the above-described meandering correction performance, however, it is necessary that the end portion of the strip material sufficiently approaches the side plate 3, and thus a certain amount of meandering is necessary to be generated. In other words, the above conventional floater is effective to large meandering but hardly expected to have the meandering correction force to small meandering.

The inventors have studied for a meandering correction method effective to the small meandering, taking account of the above-described performance of the floater, and, as a result, have conceived of an idea of tilting the strip material by forcibly changing the height position in the widthwise direction thereof so that the height position in the widthwise direction of the strip material above the floater is changed, and thus the static pressure applied to the strip material above the floater is changed, whereby the meandering correction force can be generated even in the small meandering amount, and aspects of the invention have been accomplished.

Figure 4:
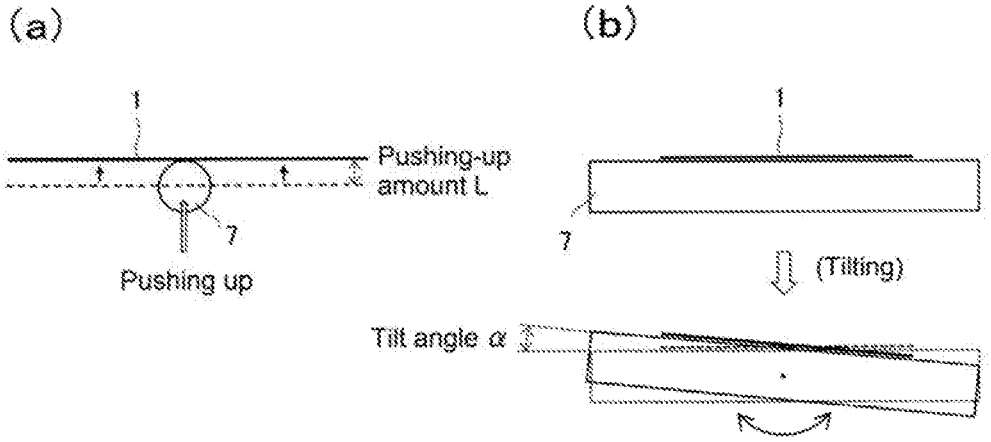
FIG. 4 is a schematic view illustrating a method and device for correcting meandering by using a cant roll.

To forcibly tilt the strip material, there is a method of arranging a roll 7 for pushing up the strip material, which is traveling in the vicinity of the floater as shown in FIG. 4(*a*), in contact with the lower face thereof, and tilting the roll 7 with respect to a horizontal surface as shown in FIG. 4(*b*), so that the strip material 1 that comes in contact with the roll 7 can be tilted. Since the roll 7 has a function of giving a tilt angle in the widthwise direction of the strip material, it is also called as a "cant roll" hereinafter.

When the conveying apparatus has a floater group comprising one or more floaters arranged in line, the cant roll may be arranged at least one of a zone between the most upstream floater in the floater group and a conveyance roll located immediately upstream of such a floater, a zone between two adjacent floaters, and a zone between the most downstream floater in the floater group and a conveyance roll located immediately downstream of such a floater.

Figure 5:
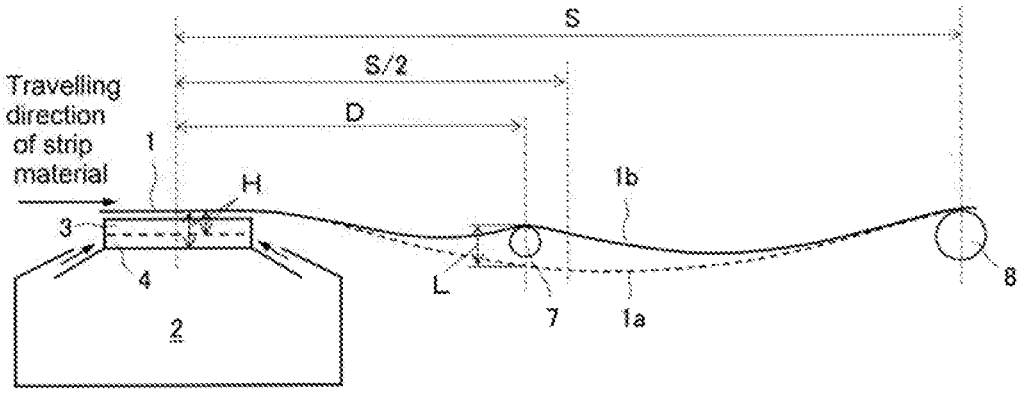
FIG. 5 is a schematic view illustrating an arrangement distance D and pushing-up amount L of a cant roll, and an average floating amount H of a strip material.

In order to develop the meandering correction performance of the cant roll more effectively, the arrangement position of the cant roll (arrangement distance D of the cant roll from a center of the floater) is preferably within S/2, where S is a distance between a center of the most upstream floater in the floater group and a center of the conveyance roll located immediately upstream of such a floater, a distance between the centers of the two adjacent floaters, or a distance between a center of the most downstream floater in the floater group and a center of the conveyance roll located immediately downstream of such a floater. That is, the cant roll is preferably arranged at the side closer to the floater than the lowest point of a suspending curve (catenary) formed by the strip material between the most upstream floater and the conveyance roll located immediately upstream of such a floater, between the two adjacent floaters, and between the most downstream floater and the conveyance roll located immediately downstream of such a floater. When the cant roll is arranged away from the above position, the effect of tilting the strip material above the floater decreases, and the meandering correction performance and responsivity become insufficient. On the other hand, the cant roll is necessary to be arranged at least apart from the floater and is preferable to be separated by not less than 100 mm. When the cant roll is arranged too close to the floater, the flow of the gas jetted from a gas jetting port of the floater is disturbed by the cant roll and it is difficult to ensure the static pressure stably and float the strip material stably. FIG. 5 shows an example that the distance between the center of the most downstream floater and the center of the conveyance roll located immediately downstream of such a floater is S.

The arrangement of the cant roll causes the strip material to come in contact with the cant roll and generates a friction force therebetween, which may lead a case that the surface of the strip material is badly affected. In such a case, the cant roll is disposed between the most downstream floater in the floater group and the conveyance roll located immediately downstream of such a floater, or at a position where heat treatment, painting treatment and the like are almost completed, whereby the above bad influence can be suppressed to a minimum level. Also, the cant roll is in contact with the strip material, but the most part of the deadweight of the strip material is supported by the floater and the conveyance rolls located immediately upstream and immediately downstream of the floater, so that the friction force generated due to the contact is sufficiently small as compared to that in the usual roll conveyance and does not damage the product quality remarkably.

An amount that the cant roll pushes up the strip material in contact with the lower face (pushing-up amount L) is preferably within the range of H/3 to 6H with respect to a pass line of the strip material before the arrangement of the cant roll, where H is an average floating amount of the strip material above the floater. The pushing-up amount L is defined as a distance from a position of the pass line of the strip material before the arrangement of the cant roll, or a pass line position of a catenary formed by the strip material before the arrangement of the cant roll to a pass line position of a catenary formed by the strip material after the pushing up with the cant roll and before the tilting of the cant roll as shown in FIG. 5. The average floating amount H is defined as an average value of a distance from the strip material to the top portion of the rib plate over a full width when the rib plate is present also as shown in FIG. 5 or an average value of a distance from the strip material to the top plate of the floater over the full width when the rib plate is not present. When the pushing-up amount L is less than H/3, the effect of tilting the strip material above the floater is deteriorated and the meandering correction performance lowers. On the other hand, when the pushing-up amount L exceeds 6H, a greater part of the deadweight of the strip material is supported by the cant roll, and the static pressure between the top plate of the floater and the strip material decreases, so that the meandering correction performance cannot be obtained sufficiently even when the strip material is tilted. More preferably, the pushing-up amount L falls within the range of $H \leq L \leq 4H$.

The pushing-up mechanism of the cant roll may be such that the pushing-up amount can be freely adjusted, and may use, for example, a power-operated cylinder, a hydraulic cylinder and so on. Also, the pushing-up mechanism is preferable to have such an evacuation function that the cant roll does not come in contact with the strip material when not in use.

The tilt angle $\alpha$ of the cant roll in the meandering correction (see FIG. 4(*b*)) preferably falls within the range of ±0.3 to 5° to a horizontal surface. When the absolute value of the tilt angle $\alpha$ is less than 0.3°, the tilt amount of the strip material is so small that the sufficient meandering correction performance cannot be developed. On the other hand, when the absolute value of the tilt angle $\alpha$ exceeds 5°, the tilt amount of the strip material is so large that the floating of the strip material becomes unstable and horizontal oscillation increases, leading the contact with the side plate. More preferably, it falls within the range of ±1 to 4°.

The meandering rate is very fast in the conveying apparatus, where the strip material is floated by the floater and the like, and the friction force (restraining force in the widthwise direction) is not exerted on the strip material, so that it is necessary to control the generated meandering in a good responsivity. To this end, it is preferable that the meandering amount is measured at an exit side of the conveying apparatus (floater group) and the tilt angle $\alpha$ of the cant roll is controlled by feedback of the measurement value on the meandering correction device arranged at the upstream side, or the meandering amount is measured at an entry side of the conveying apparatus (floater group) and the tilt angle $\alpha$ of the cant roll is controlled by feedforward of the measurement value on the meandering correction device disposed at the downstream side. Also, it is effective that the shape of the strip material is measured at a stage before the step in the conveying apparatus and the meandering tendency is predicted from the measurement result and the tilt angle $\alpha$ of the cant roll is controlled by feedforward of the prediction on the meandering correction apparatus disposed in the conveying apparatus.

In the non-contact conveying method and apparatus according to aspects of the invention, the cant roll comes in contact with the strip material. Thus, surface defects such as scratch and the like might be caused on the surface of the strip material when the threading speed (conveyance speed) of the strip material is not coincident with the rotating speed (peripheral speed) of the cant roll. In order not to cause the scratches, the difference between the conveyance speed of the strip material and the peripheral speed of the cant roll is controlled preferably within ±4 m/min, irrespectively of the value of the conveyance speed. More preferably, it is within ±2 m/min.

Moreover, the cant roll used in accordance with aspects of the invention is preferably made from a material durable to a higher temperature and a corrosive environment inside an annealing furnace or a drying furnace. For example, a ceramic roll, a metal-sprayed roll, a heat-resistant steel roll and so on are favorably used. The surface of the roll is preferably low in the friction coefficient and slippery when being in contact with the strip material, because it is advantageous to the damage of the strip material or the meandering correction. Therefore, the surface of the cant roll is preferably polished to have a surface roughness of about not more than 6 μm as an arithmetic average roughness Ra.

In order to protect the roll bearing or the sealing member which shields a furnace gas from the higher temperature or a corrosion environment inside the annealing furnace or drying furnace, it is preferable that the cant roll is disposed fully separated from the high temperature zone and a heat insulating material, a gas cooling device, a water cooling device and the like are disposed in the roll bearing and the sealing member.

EXAMPLES

An experiment is conducted such that a meandering correction device using a cant roll shown in FIG. 4 is arranged between the most downstream floater and a conveyance roll located immediately downstream of such a floater in a painting line provided with a non-contact conveying apparatus, wherein five floaters as shown in FIGS. 1 and 2 are arranged in line at an interval of 10 m between the centers of the adjacent floaters, and a cold rolled steel sheet having a sheet thickness of 0.3 mm and a sheet width of 1200 mm is conveyed under conditions described in Table 1, and the steel sheet after the painting is heated and dried at a non-contact state.

Each of the distance between the centers of the most upstream floater and the conveyance roll located immediately upstream of the floater and the distance between the centers of the most downstream floater and the conveyance roll located immediately downstream of such a floater in the above conveyance apparatus is 10 m.

The floater has a length of 1500 mm in the traveling direction of the steel sheet and a length of 1500 mm in the widthwise direction of the steel sheet, and is provided with two slit nozzles each having an opening width of 20 mm and a length in the widthwise direction of the steel sheet of 1500 mm on the top portion of the floater at an interval of 1100 mm in the traveling direction of the steel sheet. Side plates having a height of 50 mm are arranged standing on a top plate located on the top portion at both widthwise end parts thereof, and rib plates having a height of 25 mm are arranged standing at an interval of 100 mm in the widthwise direction of the sheet in 14 rows between the side plates.

Also, the cold rolled steel sheet used in this experiment has a good shape having an elongation difference rate in the widthwise direction of less than 0.005%. As the conveyance conditions, an internal pressure of the floater is set to about 0.6 kPa, and an average floating height of the steel sheet is set to 25 mm on average, and a tension of the steel sheet is set to 0.6 kgf/mm$^2$.

TABLE 1

| | Conveyance experimental conditions | | | | | Experimental results | | |
|---|---|---|---|---|---|---|---|---|
| Experiment No. | Arrangement distance D of cant roll (mm) | Pushing-up amount L (mm) | Tilt angle α of cant roll (°) | Conveyance rate (m/min) | Rotating rate of cant roll (m/min) | Meandering correction time (sec) | Presence or absence of generating scratch | Remarks |
| 1 | — | — | — | 100 | — | Out of control | absence | Comparative Example |
| 2 | 5000 | 8 | 0.3 | 100 | 100 | 18 | absence | Invention Example |
| 3 | 5000 | 150 | 0.3 | 100 | 100 | 17 | absence | Invention Example |
| 4 | 5000 | 8 | 5.0 | 100 | 100 | 13 | absence | Invention Example |
| 5 | 5000 | 150 | 5.0 | 100 | 100 | 12 | absence | Invention Example |
| 6 | 800 | 8 | 0.3 | 100 | 100 | 16 | absence | Invention Example |
| 7 | 800 | 150 | 0.3 | 100 | 100 | 15 | absence | Invention Example |
| 8 | 800 | 8 | 5.0 | 100 | 100 | 8 | absence | Invention Example |
| 9 | 800 | 150 | 5.0 | 100 | 100 | 6 | absence | Invention Example |
| 10 | 1500 | 25 | 2.0 | 100 | 100 | 10 | absence | Invention Example |
| 11 | 1500 | 100 | 2.0 | 100 | 100 | 11 | absence | Invention Example |
| 12 | 6000 | 25 | 2.0 | 100 | 100 | 115 | absence | Invention Example |
| 13 | 1500 | 5 | 2.0 | 100 | 100 | 43 | absence | Invention Example |
| 14 | 1500 | 200 | 2.0 | 100 | 100 | 89 | absence | Invention Example |
| 15 | 1500 | 25 | 0.2 | 100 | 100 | 31 | absence | Invention Example |
| 16 | 1500 | 25 | 6.0 | 100 | 100 | 9 | Scratch generated in sheet widthwise end | Invention Example |
| 17 | 1500 | 25 | 2.0 | 100 | 102 | 10 | absence | Invention Example |
| 18 | 1500 | 25 | 2.0 | 100 | 104 | 9 | absence | Invention Example |
| 19 | 1500 | 25 | 2.0 | 100 | 106 | 12 | Minute scratch generated on surface | Invention Example |
| 20 | 1500 | 25 | 2.0 | 100 | 98 | 10 | absence | Invention Example |
| 21 | 1500 | 25 | 2.0 | 100 | 96 | 10 | absence | Invention Example |
| 22 | 1500 | 25 | 2.0 | 100 | 94 | 11 | Minute scratch generated on surface | Invention Example |
| 23 | 1500 | 25 | 2.0 | 200 | 200 | 5 | absence | Invention Example |
| 24 | 1500 | 25 | 2.0 | 200 | 202 | 6 | absence | Invention Example |
| 25 | 1500 | 25 | 2.0 | 200 | 204 | 5 | absence | Invention Example |
| 26 | 1500 | 25 | 2.0 | 200 | 206 | 6 | Minute scratch generated on surface | Invention Example |
| 27 | 1500 | 25 | 2.0 | 200 | 198 | 6 | absence | Invention Example |
| 28 | 1500 | 25 | 2.0 | 200 | 196 | 6 | absence | Invention Example |
| 29 | 1500 | 25 | 2.0 | 200 | 194 | 5 | Minute scratch generated on surface | Invention Example |

In the above experiment, a meandering correction performance is evaluated by tilting the cant roll at a non-meandering state (meandering amount: 0 mm) to generate meandering of 20 mm, then reversing the cant roll to have a tilt angle α shown in Table 1, and measuring a time required for the meandering amount returning to 0 mm (meandering correction time), and further the presence or absence of generation of the scratch on the steel sheet surface and the degree thereof are evaluated.

Other than the tilt angle α of the cant roll, the arrangement distance D of the cant roll (distance from the center of the most downstream floater to a top of the cant roll), the pushing-up amount L of the cant roll, the threading speed of the cold rolled steel sheet, and a peripheral speed of the cant roll are variously changed as shown in Table 1, and also a surface inspection is conducted at an exit side of the line to evaluate the presence or absence of generation of the scratch on the steel sheet surface and the degree thereof.

Moreover, the meandering amount is measured by detecting an edge position of the steel sheet by a two-dimensional laser sensor in the vicinity of the conveyance roll located immediately downstream of the most downstream (the first)

floater. Also, the scratch is inspected visually under a sufficiently bright fluorescent lamp at an exit side of the painting line.

The results of the above conveyance experiment are shown also in Table 1. The followings are understood from these results.

When the meandering correction device according to aspects of the invention is not used (Experiment No. 1), meandering itself cannot be generated, where there is no meandering correction performance.

On the other hand, when the meandering correction device according to aspects of the invention is used (Experiment Nos. 2 to 29), forcibly generated meandering is corrected by tilting the cant roll under all conditions, whereby the meandering amount can be returned to 0 mm.

However, when the arrangement position of the cant roll, the pushing-up amount L of the cant roll, and the tilt angle $\alpha$ of the cant roll are out of the range preferable to aspects of the invention, the meandering correction time until the meandering amount is returned to 0 mm tends to increase.

Also, when the difference between the peripheral speed of the roll (rotating speed) and the conveyance speed (threading speed) of the steel sheet is not more than 4 m/min, the generation of scratch is not observed, while when the speed difference exceeds 4 m/min, minute scratch is confirmed. Also, when the tilt angle $\alpha$ of the cant roll exceeds the preferable range, the floating of the steel sheet becomes unstable and scratch is observed in a part of the end portion of the steel sheet (edge portion). However, the observed scratch is minimal and is within an acceptable range as a product.

INDUSTRIAL APPLICABILITY

The technique according to aspects of the invention is not limited to the cold rolled steel sheet described in the above examples and can be applied to a strip-like metallic plate such as aluminum plate, copper plater or the like and a strip-like substrate such as plastic, paper or the like.

REFERENCE SIGN LISTS

1: strip material
1*a*: pass line of strip material before arrangement of cant roll
1*b*: pass line of strip material after arrangement of cant roll
2: floater
3: side plate
4: rib plate
5: gas jetting port (slit nozzle)
6: top plate of floater
7: cant roll
8: conveyance roll

The invention claimed is:

1. A method for correcting meandering of a strip material in an apparatus that performs conveyance of a continuously travelling strip material at a non-contact state while floating the strip material by a floater group comprising one or more floaters arranged in line, characterized in that the strip material is tilted by forcibly changing a height position in the widthwise direction of the strip material in at least one of a zone between the most upstream floater in the floater group and a conveyance roll located immediately upstream of such a floater, a zone between two adjacent floaters, and a zone between the most downstream floater in the floater group and a conveyance roll located immediately downstream of such a floater to change the height position in the widthwise direction of the strip material above the floater, whereby a static pressure applied to the strip material above the floater is changed to correct meandering thereof, wherein a cant roll is arranged in a zone where the strip material is tilted so as to come in contact with the lower face of the travelling strip material and push up the strip material and is tilted with respect to a horizontal surface to change the height position of the cant roll in the widthwise direction of the strip material, whereby the strip material is tilted, and wherein an arrangement distance of the cant roll falls within S/2 from a center of a floater, where S is a distance between a center of the most upstream floater in the floater group and a center of the conveyance roll located immediately upstream of such a floater, a distance between the centers of the two adjacent floaters, or a distance between a center of the most downstream floater in the floater group and a center of the conveyance roll located immediately downstream of such a floater.

2. The method for correcting meandering of a strip material according to claim 1, wherein a pushing-up amount of the cant roll falls within a range of H/3 to 6H with respect to a pass line of the strip material before the arrangement of the cant roll, where H is an average floating amount of the strip material above the floater.

3. The method for correcting meandering of a strip material according to claim 1, wherein a tilt angle of the cant roll falls within a range of ±0.3 to 5° with respect to a horizontal surface.

4. The method for correcting meandering of a strip material according to claim 1, wherein the tilt angle of the cant roll is controlled by feed-back control and/or feed-forward control based on measurement results of a meandering amount of the strip material.

5. The method for correcting meandering of the strip material according to claim 1, wherein a peripheral speed of the cant roll is controlled within a range of ±4 m/min with respect to a conveyance speed of the strip material.

6. A device for correcting meandering of a strip material in an apparatus that performs conveyance of a continuously travelling strip material at a non-contact state while floating the strip material by a floater group comprising one or more floaters arranged in line, characterized in that the device is provided with a tilting means for correcting meandering of a strip material in at least one of a zone between the most upstream floater in the floater group and a conveyance roll located immediately upstream of the floater, a zone between two adjacent floaters, and a zone between the most downstream floater in the floater group and a conveyance roll located immediately downstream of such a floater and the tilting means forcibly changes the height position in the widthwise direction of the strip material to tilt thereof and change the height position in the widthwise direction of the strip material above the floater, whereby a static pressure applied to the strip material above the floater is changed to correct meandering thereof, wherein the tilting means for correcting meandering of a strip material is provided with a cant roll arranged so as to come in contact with the lower face of the travelling strip material and push up the strip material in the zone where the strip material is tilted and the cant roll is tilted with respect to a horizontal surface to change a height position of the cant roll in the widthwise direction of the strip material, whereby the strip material is tilted, and wherein the cant roll is arranged in a position within S/2 from a center of a floater, where S is a distance between a center of the most upstream floater in the floater group and a center of the conveyance roll located immediately upstream of such a floater, a distance between the centers of the two adjacent floaters, or a distance between a center of the most downstream floater in the floater group and a center of the conveyance roll located immediately downstream of such a floater.

7. The device for correcting meandering of a strip material according to claim 6, wherein the cant roll can push up the strip material within a range of H/3 to 6H with respect to a pass line of the strip material before the arrangement of the cant roll, where H is an average floating amount of the strip material above the floater.

8. The device for correcting meandering of a strip material according to claim 6, wherein the tilt angle of the cant roll can be controlled within a range of ±0.3 to 5° with respect to a horizontal surface.

9. The device for correcting meandering of a strip material according to claim 6, wherein the tilt angle of the cant roll is controlled by feed-back control and/or feed-forward control based on measurement results of a meandering amount of the strip material.

* * * * *